US005160921A

United States Patent [19]

Killinger

[11] Patent Number: 5,160,921

[45] Date of Patent: Nov. 3, 1992

[54] DISPLAY APPARATUS FOR ALPHANUMERIC DISPLAYS

[75] Inventor: Erich Killinger, Gaggenau, Fed. Rep. of Germany

[73] Assignee: Dambach-Werke GmbH, Fed. Rep. of Germany

[21] Appl. No.: 452,225

[22] Filed: Dec. 18, 1989

[30] Foreign Application Priority Data

May 19, 1989 [DE] Fed. Rep. of Germany ..... 3916290

[51] Int. Cl.[5] ..... G09G 3/34

[52] U.S. Cl. ..... 340/783; 340/815.31

[58] Field of Search ..... 340/783, 784, 815.31; 350/96.15, 96.2, 96.27

[56] References Cited

U.S. PATENT DOCUMENTS

| | | | |
|---|---|---|---|
| 3,899,786 | 8/1975 | Greubel et al. | 340/815.31 |
| 3,962,702 | 6/1976 | Kriege | 340/815.31 |
| 4,299,447 | 11/1981 | Soltan et al. | 340/815.31 |
| 4,646,074 | 2/1987 | Hashimoto | 340/784 |
| 4,794,391 | 12/1988 | Costa et al. | 340/815.31 |
| 4,839,635 | 6/1989 | Harris et al. | 340/815.31 |

FOREIGN PATENT DOCUMENTS

| | | | |
|---|---|---|---|
| 2831174 | of 1979 | Fed. Rep. of Germany . | |
| 3303917 | 8/1984 | Fed. Rep. of Germany | 340/815.31 |
| 3434355 | 6/1986 | Fed. Rep. of Germany . | |

*Primary Examiner*—Ulysses Weldon
*Assistant Examiner*—M. Fatahiyar
*Attorney, Agent, or Firm*—Speckman & Pauley

[57] ABSTRACT

This invention relates to a display apparatus for alphanumeric displays having a display panel. A controllable light source illuminates a bundle of optical fibers and in which one switch element is triggerable from a control line. The switch element is introduced into each light path leading from an optical fiber to a display element, and with the switch element the associated light path can be selectively opened or blocked. A multi-color representation of the displays is attained by each display element of the display panel having a variable number of light paths. The display elements are disposed in the same variable number of internested matrices. The optical fibers associated with one matrix are joined into bundles and are illuminated by separate light sources. The control lines of the switch elements are individually triggerable for the various matrices with a control unit in order to represent the variable number of alphanumeric displays or a multi-color alphanumeric displays simultaneously, where in the latter case filters are connected to the output side of the light sources or optical fibers.

15 Claims, 2 Drawing Sheets

DISPLAY APPARATUS FOR ALPHANUMERIC DISPLAYS

BACKGROUND OF THE INVENTION

1. Field of the Invention

This invention relates to a display apparatus for alphanumeric displays having a display panel. In the display apparatus, a light source illuminates a bundle of optical fibers and a switch element is triggerable by a control line which is inserted into each light path leading from an optical fiber to a display element. The switch element controls the associated light path which can be selectively opened or blocked.

2. Description of the Prior Art

A display apparatus of this type is known from German Published, Unexamined Patent Application 28 31 174. In this known display apparatus, all the display elements are joined together into a permanently lighted optical fiber bundle. The switch elements incorporated into each light path are individually triggerable, so that by their triggering, any arbitrary alphanumeric display can be tripped, and only the resolution of the display panel comprising the display elements limits the possibilities for display. However, a display is only possible in one color, and the display is capable of including a plurality of subimages. The display depends solely on triggering the switch elements and the display elements are thereby enabled.

SUMMARY OF THE INVENTION

It is an object of the invention to improve a display apparatus wherein a multi-color alphanumeric display is possible since multi-color alphanumeric displays are needed for traffic signs on streets and highways.

According to this invention, the object is accomplished by each display element of the display panel having a light path. The display elements are disposed in n internested matrices. The optical fibers associated with one matrix are joined into bundles and are illuminated by separate light sources. The control lines of the switch elements are triggerable individually for the various matrices with a control unit. In order to represent n alphanumeric displays or an n-color alphanumeric display simultaneously, filters are connected to the output side of the light sources or optical fibers.

The number of matrices determines the number of colors in a display. It is also possible to show n displays independently of one another on the display panel. To show n displays independently, only certain portions of the display panel are assigned through the triggering of the switch elements. The displays may also have different colors. This embodiment is advantageous for this purpose wherein one control subcircuit is associated with each matrix of the switch elements, from which a subcircuit of each switch element of the matrix is triggerable individually, and the control subcircuits are triggerable by the control unit in accordance with the desired displays or sub-displays.

In accordance with another embodiment, the control commands for the control unit are contained in a programmable memory, where most of the various displays can be specified and retrieved as needed and displayed.

In another embodiment, it is advantageous that the memory is triggerable from remote lines and control commands for new and/or additional displays which can be transferred to the memory. Then all that is necessary is that the displays can be tripped by display commands, which can be supplied to the control unit for individual displays.

The selective opening or blocking of a light path can be performed in accordance with one embodiment by disposing switch elements in the optical fibers or at at least one end thereof and varying the wavelength of the waves beamed into the optical fibers.

In accordance with one embodiment, the structural design of the display panel has a display plate. The display plate has a number of light exit cones corresponding to the number of display elements. The number of display elements and a support plate have a corresponding number of bores for receiving the ends of the optical fibers and for receiving one control tube each. Each control tube has a switch element. The switch element connects each bore of the support plate with the associated light exit cone of the display plate.

The switch elements may also be embodied as rotatably supported butterfly valves electrically actuated by a coil. In this embodiment, filters for the light waves are also possible. The pass characteristics of the filters may be varied magnetically, electrically or thermally. Switch elements embodied as liquid crystals are particularly suitable for this purpose.

The invention will now be described in further detail, in terms of preferred embodiments shown in the drawings.

DESCRIPTION OF THE PREFERRED EMBODIMENTS

Figure 1:
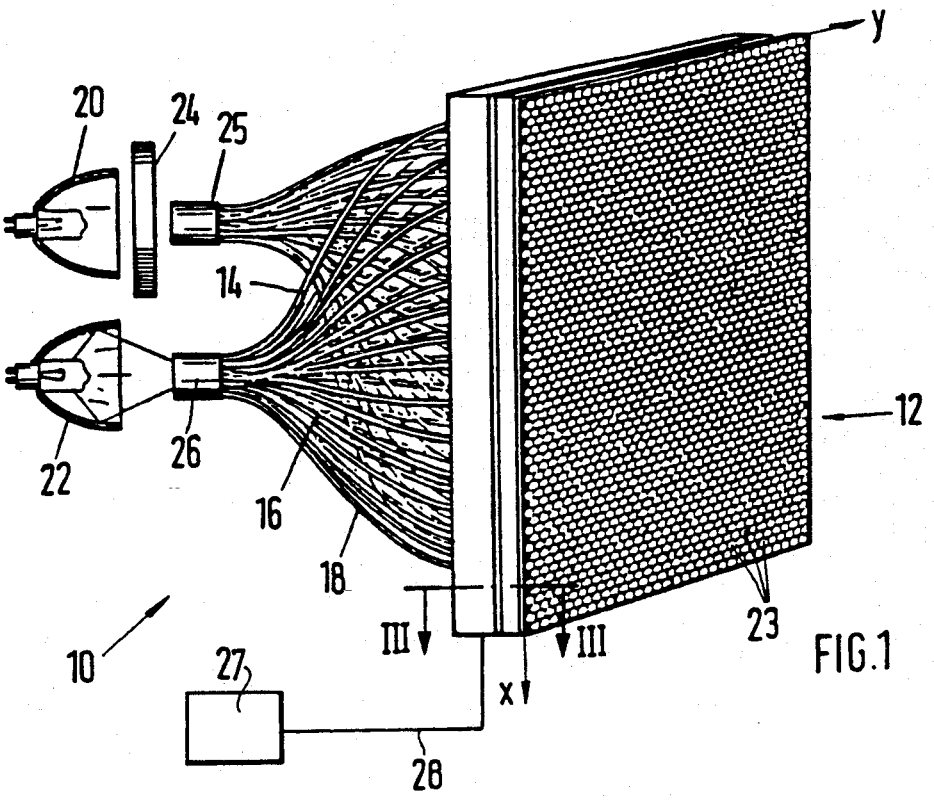
FIG. 1 shows a display panel with optical fibers and light source showing alphanumeric displays.

In FIG. 1, part of a display apparatus 10 for alphanumeric displays is shown. The display may be shown by selection or combinations of individual display elements on display panel 12. Display panel 12 has two internested matrices of display elements 23. Display elements 23 associated with the first matrix are illuminated by a first optical fiber bundle 25. Light source 20 illuminates light which passes through filter 24 and illuminates first optical fiber bundle 25. According to a preferred embodiment, light source 20 is a halogen lamp. The optical fibers of bundle 25 may be carried to all display elements 23 of the odd-numbered lines on display panel 12. Optical fibers 14, 16 and 18 of bundle 26 are then carried to all display elements 23 of the even-numbered lines on display panel 12. The illumination of second optical fiber bundle 26 is performed by light source 22. The control of the switch elements accommodated in display panel 12 is performed by control unit 27, from lines 28 that lead to the switch elements, as described below.

In a preferred embodiment, display panel 12 has two-color displays. It is within the scope of this invention, however, to divide display elements 23 of display panel 12 into more than two matrices and to provide a corresponding number of optical fiber bundles and light sources. Since each coordinate point on the display panel then includes one display element per matrix, all the optical fiber bundles are identical. Different filters may be associated with the light sources.

Figure 2:
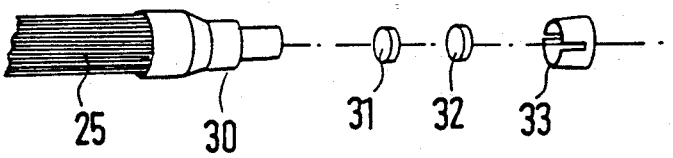
FIG. 2 shows an end of an optical fiber.

The end shown in FIG. 2 of optical fiber bundle 25 is received by socket 30 and can be covered by with a filter clamp bushing 33. Filter clamp bushing 33 receives one color filter 31 and one heat shield filter 32. In this embodiment, color filter 31 is held directly in front of the light entry face of optical fiber bundle 25.

Figure 3:
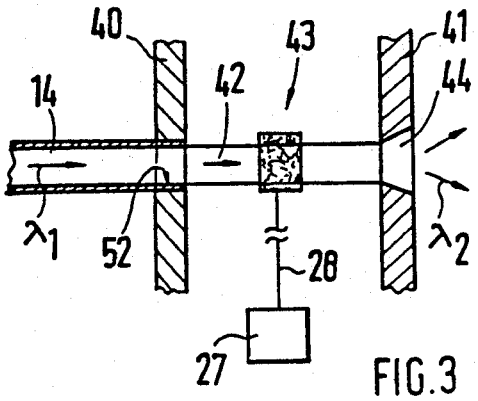
FIG. 3 shows a fragmentary section through a light path along the line III—III of FIG. 1.
Figure 4:
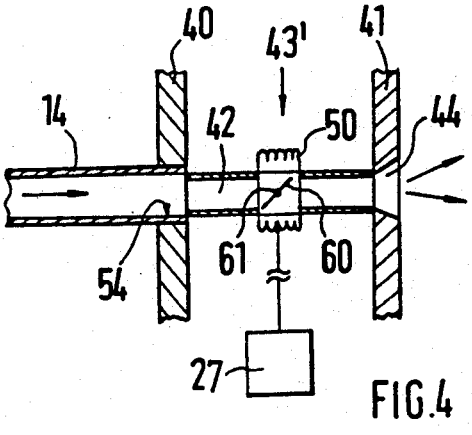
FIG. 4 shows a fragmentary section through a light path along the line III—III of FIG. 1 having a different embodiment of a switch element.

FIG. 1, together with FIGS. 3 and 4, shows that display panel 12 has a display plate 41 on its front side and a retaining plate 40 on its back side. The ends of optical fibers 14 can be connected in bores 52 and 54. As shown in FIGS. 3 and 4, each bore 52 and 54 is connected with one control tube 42. Control tube 42 is disposed between display plate 41 and retaining plate 40. Control tube 42 receives switch element 43 or 43'.

In FIG. 3, switch element 43 is shown as a filter for electromagnetic waves. The pass characteristic of the filter is variable thermally, magnetically or electrically. In a preferred embodiment, switch element 43 is a liquid crystal. The electromagnetic wave passing through optical fibers 14 has a wavelength lambda 1, while the wave emitted from exit cone 44 has a wavelength lambda 2. By applying a predetermined voltage to switch element 43, its filter properties can be intentionally varied, so that switch element 43 is pervious only for the particular wavelength that is emitted by the associated light source.

In FIG. 4, switch element 43' comprises a butterfly valve 60. Butterfly valve 60 is pivotable about a pivot shaft 61. Switch element 43' is controllable by a magnetic field generated by coil 50. Coil 50 is triggerable by control unit 27.

Figure 5:
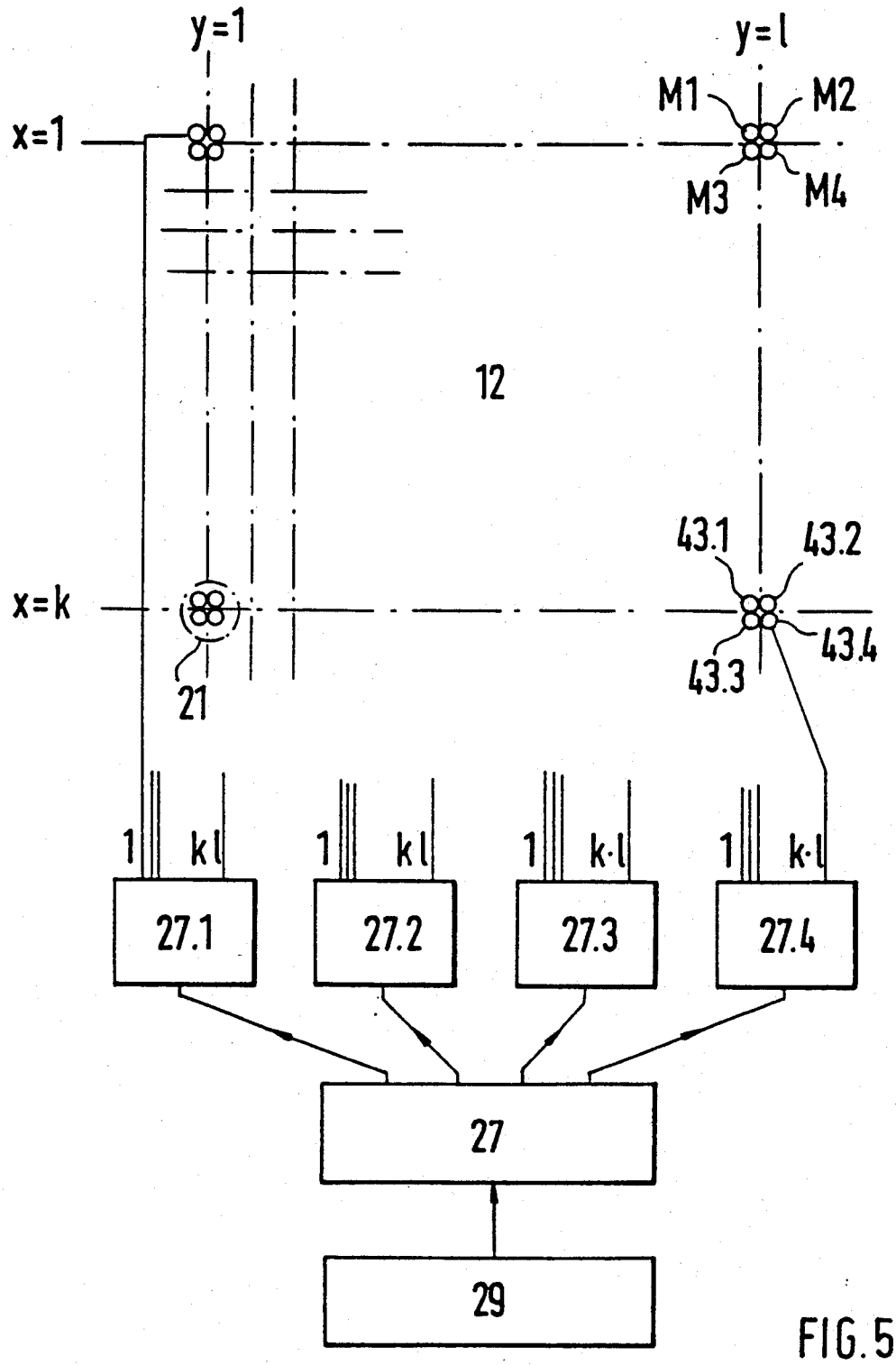
FIG. 5 shows a circuit diagram for triggering a display panel having four internested matrices.

FIG. 5 shows a preferred embodiment of a circuit diagram for a display panel 12 having four internested matrices M1-M4. Each coordinate point 21 of display panel 12 has four display elements and hence also has four switch elements 43.1-43.4. Display panel 12 is intended to have x=1 through x=k lines and y=1 through y=1 columns, so that k.l coordinate points each with four switch elements 43.1-43.4 are required. The k.l switch elements of the matrices M1-M4 are triggerable individually from control subcircuits 27.1-27.4, so that each control subcircuit must have k.l control lines to the associated switch elements. In this embodiment, each matrix M1-M4 can be triggered individually. Coordinate triggering of the switch elements is not possible, because depending on the display it is also necessary to trigger a plurality of switch elements of different lines and columns. If control unit 27 is triggered for a predetermined display, it can retrieve various control commands from programmable memory 29 and send them, by control subcircuits 27.1-27.4, to the switch elements of the matrices M1-M4. It is also possible, for example, by remote lines, to feed new and/or additional control commands for further or different displays into programmable memory 29 and to cause these to be displayed by suitable display commands from control unit 27. Since each coordinate point 21 of display panel 12 is triggerable by each matrix M1-M4, a display apparatus is created where it is possible to show displays of up to four colors. It is also possible to use fewer colors for the display. The number of colors depends solely on the control commands for a predetermined display that are stored in programmable memory 29. After all, arbitrary matrices can be used for a display. Control unit 27, in combination with programmable memory 29, affords the greatest versatility. The display is limited only by the resolution capacity, which is defined by display elements 23 accommodated at one coordinate point 21 and by the number of coordinate points k.l on display panel 12.

I claim:

1. In a display apparatus for alphanumeric displays having a display panel (12), a plurality of display elements (23,), a plurality of controllable light sources (20, 22) which illuminate a plurality of bundles of optical fibers (25, 26), a plurality of switch elements (43, 43'; 43.1-43.4) triggerable from a control line, one of said switch elements (43, 43'; 43.1-43.4) introduced into each light path leading through an optical fiber (14, 16, 18) of said bundle of optical fibers (25, 26) to each said display element (23), and said switch element (43, 43'; 43.1-43.4) selectively controlling said light path, the improvement comprising: each said display element (23) of said display panel (12) having one said light path;

said display elements (23) being disposed in at least two internested matrices (M1-M4);

each said bundle of optical fibers (25, 26) associated with one of said internested matrices (M1-M4), each said bundle of optical fibers (25, 26) illuminated by a separate one of said controllable light sources (20, 22);

each said switch element (43, 43'; 43.1-43.4) individually triggerable through said control line (1-k.l) by one of a plurality of control subcircuits (27.1-27.4) for each of said matrices (M1-M4) by a control unit (27), generating at least one of said alphanumeric displays and a multi-color alphanumeric display simultaneously, said multi-color alphanumeric display having filters (24, 31) disposed between said light source (20, 22) and said optical fibers (14, 16, 18);

one of said control subcircuits (27.1-27.4) being associated with each of said matrices (M1-M4), each said switch element of each of said matrices (M1-M4) being individually triggerable by one of said control subcircuits (27.1-27.4); and said control subcircuits (27.1-27.4) being triggerable by said control unit (27).

2. In a display apparatus according to claim 1, wherein control commands for said control unit (27) are contained in a programmable memory (29).

3. In a display apparatus according to claim 2, wherein said programmable memory (29) is triggerable through remote lines; and additional control commands for additional displays are transferable to said programmable memory (29).

4. In a display apparatus according to claim 3, wherein said alphanumeric displays are generated by at least one display command, which is supplied to said control unit (27) for each of said alphanumeric displays.

5. In a display apparatus according to claim 1, wherein alphanumeric displays are generated by at least one display command, which is supplied to said control unit (27) for each of said alphanumeric displays.

6. In a display apparatus according to claim 1, wherein each said switch element (43, 43'; 43.1-43.4) is disposed in one of said optical fibers (14, 16, 18) or disposed at at least one end of one of said optical fibers (14, 16, 18) and varies a wavelength (lambda) of waves beamed through respective one of said optical fibers (14, 16, 18).

7. In a display apparatus according to claim 4, wherein each of said switch elements (43, 43'; 43.1–43.4) is disposed in one of said optical fibers (14, 16, 18) and disposed at at least one end of one of said optical fibers (14, 16, 18) or varies a wavelength (lambda) of waves beamed through respective one of said optical fibers (14, 16, 18).

8. In a display apparatus according to claim 1, wherein said display panel (12) has a display plate (41), said display plate (41) having a plurality of light exit cones (44), the number of which corresponds to the number (n) of said display elements (23), and having a support plate (40), said support plate (40) having a corresponding number of bores (52, 54) for receiving an end of each said optical fiber (14, 16, 18) and for receiving one control tube (42), said control tube (42) having one of said switch elements (43, 43'), one of said switch elements (43, 43') connecting each said bore (52, 54) of said support plate (40) to a corresponding said light exit cone (44) of said display plate (41).

9. In a display apparatus according to claim 5, wherein said display panel (12) has a display plate (41), said display plate (41) having a plurality of light exit cones (44), the number of which corresponds to the number (n) of said display elements (23), and having a support plate (40), said support plate (40) having a corresponding number of bores (52, 54) for receiving an end of each said optical fiber (14, 16, 18) and for receiving one control tube (42), said control tube (42) having one of said switch elements (43, 43'), one of said switch elements (43, 43') connecting each said bore (52, 54) of said support plate (40) to a corresponding said light exit cone (44) of said display plate (41).

10. In a display apparatus according to claim 1, wherein each of said switch elements (43') comprises a rotatably supported butterfly valve (60) which is electrically actuated with a coil (50).

11. In a display apparatus according to claim 6, wherein each of said switch elements (43') comprises a rotatably supported butterfly valve (60) which is electrically actuated with a coil (50).

12. In a display apparatus according to claim 1, wherein each of said switch elements (43) comprises a filter for light waves, said filter having at least one pass characteristic which is at least one of magnetically, electronically and thermally variable.

13. In a display apparatus according to claim 6, wherein each of said switch elements (43) comprises a filter for light waves, said filter having at least one pass characteristic which is at least one of magnetically, electronically and thermally variable.

14. In a display apparatus according to claim 13, wherein each of said switch elements (43) comprises a plurality of liquid crystals.

15. In a display apparatus according to claim 12, wherein each of said switch elements (43) comprises a plurality of liquid crystals.

* * * * *